US006415483B1

(12) United States Patent
Dang

(10) Patent No.: US 6,415,483 B1
(45) Date of Patent: Jul. 9, 2002

(54) JEWELRY CLASP

(76) Inventor: Downey Dang, 784 Buckskin Cir., Norcross, GA (US) 30093

( * ) Notice: Subject to any disclaimer, the term of this patent is extended or adjusted under 35 U.S.C. 154(b) by 0 days.

(21) Appl. No.: 09/611,218

(22) Filed: Jul. 6, 2000

(51) Int. Cl.[7] ..... A44C 5/00
(52) U.S. Cl. ..... 24/694; 24/265 R
(58) Field of Search ..... 63/3.1, 3, 40, 38, 63/29.1; 24/685, 574.1, 694, 265 R, 265 B, 265 WS

(56) References Cited

U.S. PATENT DOCUMENTS

| | | | | |
|---|---|---|---|---|
| 227,592 | A | | 5/1880 | Smith |
| 1,498,109 | A | * | 6/1924 | Mulholland |
| 1,516,223 | A | * | 11/1924 | Wadsworth |
| 1,807,293 | A | * | 5/1931 | Keller |
| 1,982,501 | A | | 11/1934 | Douglas |
| 2,086,050 | A | | 7/1937 | Schwalberg |
| 2,148,629 | A | | 2/1939 | Levesque |
| 2,163,208 | A | | 6/1939 | Moody |
| 2,274,207 | A | | 2/1942 | Merz |
| 2,440,728 | A | | 5/1948 | Siegel |
| 2,552,415 | A | | 5/1951 | Fachon |
| 2,663,924 | A | | 12/1953 | Albrecht |
| 2,990,988 | A | * | 7/1961 | Ziegenbein |
| 3,259,283 | A | * | 7/1966 | Moinat |
| 3,680,304 | A | | 8/1972 | Heckel |
| 3,765,064 | A | | 10/1973 | Hoober |
| 4,401,388 | A | | 8/1983 | Mearns |
| 5,416,953 | A | * | 5/1995 | Hui |
| 5,678,282 | A | * | 10/1997 | Stewart |
| 6,112,373 | A | * | 9/2000 | Steinhauer et al. |

* cited by examiner

*Primary Examiner*—James R. Brittain
(74) *Attorney, Agent, or Firm*—Barry E. Kaplan, Esq.; Hughes & Kaplan

(57) ABSTRACT

A jewelry clasp assembly, attached to a pair of chains for displaying pearls, gemstones, gems, beads, slides, or the like, including a pair of rectangular shaped pins slidably engaged into similarly shaped receiving channels within said clasp housing and secured in place by a threaded retaining pin passing through the receiving channels and the rectangular shaped pins. The jewelry clasp so provided allows the uncomplicated addition and removal of slides, beads, and gems to and from a pair of chains, without compromising security from accidental loss.

19 Claims, 2 Drawing Sheets

JEWELRY CLASP

TECHNICAL FIELD

The present invention relates generally to jewelry; and, more specifically, to a jewelry clasp assembly attached to a pair of chains for displaying gems, gemstones, pearls, beads, or the like.

BACKGROUND OF THE INVENTION

Throughout history, physical adornment with precious metals and gems has remained prevalent. The universal appeal of jewelry endures despite continually changing trends worldwide. Such trends, however, have influenced changes in the design and use of jewelry. For example, men and women no longer keep their jewelry secreted away for a special occasion. Jewelry, such as rings, necklaces, and bracelets are now worn on a daily basis.

Design changes continue, some arising from purely aesthetic pursuits and others emerging from practical needs. One functional element of bracelets, necklaces, and anklets is the clasp. Practical changes designed to affect ease of use and security of closure have been proposed. However, functional design has not always kept pace with aesthetic design trends.

One such example is the currently popular slide style of bracelet. A slide bracelet features at least one chain which may carry a plurality of slides which may, in turn, carry gems, pearls, beads, gemstones, or the like. Such a bracelet may carry one or more slides, or may be completely filled. The allure of such a bracelet may be its endless variations. Another attraction may be the flexibility of the purchase. Unlike traditionally ornate bracelets which have remained unaffordable to some individuals, slide bracelets can be purchased in a piecemeal manner. For instance, the chain portion can be purchased alone, or with just one slide. Additional slides can continue to be purchased, resulting in a glamorous piece of jewelry with a value far exceeding what could have been paid for in a single purchase event.

An essential feature of such a bracelet is the continued ability to add slides to the chain. Typically, this has been accomplished by one of several methods. One method that is common for slide necklaces is that the slide has a bore large enough to fit over the clasp; thus, allowing the individual the ability to add or remove slides at will. This method, however, is unsuitable for security reasons. More specifically, when the clasp is unlatched, the slides can fall off and become lost. Furthermore, this method is troublesome for bracelets with two chains. Multiple chains are typically connected to a cross piece which then secures to the clasp. Since slides for double-chain bracelets typically include a double bore, which provides the added function of maintaining chain separation, the cross piece prevents sliding them on over the clasp.

When the slide has a double bore, or when the single bore is smaller than the clasp circumference, an alternative method is to bring the bracelet to a jeweler for each slide addition. The jeweler must then either open and close a hinged attachment clasp; thereby, potentially weakening or damaging the bracelet chain with the clasp teeth, or use soldering methods to reattach the clasp following addition of the slide. While these methods offer increased security for the slide, they are inconvenient, costly, and potentially damaging to the bracelet clasp and chain over time. Furthermore, such "permanent" addition of the slides removes the bracelet's endless-variety appeal.

Therefore, it is readily apparent that there is a need for a jewelry clasp that will allow the uncomplicated addition and removal of slides to a bracelet, while still providing adequate protection from accidental loss, and, thereby, eliminating the above-discussed disadvantages.

BRIEF SUMMARY OF THE INVENTION

Briefly described, in a preferred embodiment, the present invention overcomes the above-mentioned disadvantages, and meets the recognized need for such a device, by providing a jewelry clasp which will allow the uncomplicated addition and removal of slides, which may carry beads and gems, to a pair of chains without compromising security from accidental loss.

According to its major aspects, and broadly stated, the present invention is a jewelry clasp preferably carried within a clasp assembly and attached to at least one chain for displaying slides which may carry beads, pearls, gems or gemstones, and comprising at least one preferably rectangular shaped pin which is placed into a receiving channel and secured into place by a threaded attaching screw.

More specifically, the device of the present invention is a jewelry clasp comprising preferably a pair of receiving channels for rectangular shaped pins and a receptacle for securing a threaded screw. The threaded screw has a first end and a second end, the first end comprising a threaded portion and the second end comprising a head. The preferably rectangular shaped pins have a first end and a second end, wherein the first end is attached to a chain, and wherein the second end has a through-hole formed therein for securing to the housing. The threaded screw receptacle corresponds in exterior design with that of the screw head and is oriented and dimensioned in such a manner so as to allow the threaded screw to pass through the rectangular shaped pin through-holes; thus, securing the rectangular shaped pins, and the chains attached thereto, to the clasp assembly.

Thus, an object, feature, and advantage of the present invention is to provide a jewelry clasp which will allow the uncomplicated addition and removal of slides to a plurality of chains without compromising security from accidental loss.

Another object, feature, and advantage of the present invention is to provide a jewelry clasp such that the jewelry clasp housing comprises at least one receiving channel for receiving a pin having a first end and a second end, wherein the first end carries a chain and wherein the second end comprises a through-hole.

Yet another object, feature, and advantage of the present invention is to provide a jewelry clasp such that the jewelry clasp housing comprises at least one receptacle for a threaded screw.

Still another object, feature, and advantage of the present invention is to provide a jewelry clasp such that the jewelry clasp housing exterior may incorporate a variety of styles, designs, decorative features, and gems.

Yet still another object, feature, and advantage of the present invention is to provide a jewelry clasp such that the threaded screw receptacle and screw head may incorporate a variety of styles, designs, decorative features, and gems.

These and other objects, features, and advantages of the present invention will become more apparent to one skilled in the art from the following Detailed Description of the Preferred and Alternate Embodiments and claims when read in view of the accompanying Drawings.

BRIEF DESCRIPTION OF THE DRAWINGS

The present invention will be better understood by reading the Detailed Description of the Preferred and Alternate Embodiments with reference to the accompanying Drawing figures, in which like reference numerals denote similar structure and refer to like elements throughout, and in which.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE PREFERRED AND ALTERNATE EMBODIMENTS

In describing the preferred embodiment of the present invention, as illustrated in the Figures, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
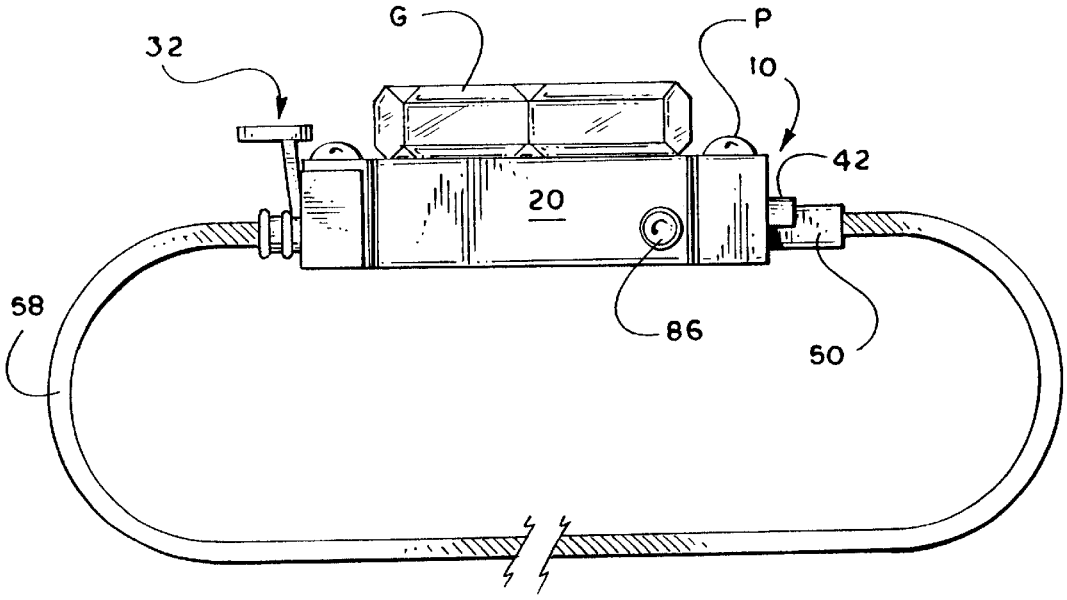
FIG. 1 is a side view of the jewelry clasp of the present invention showing the attachment thereof to a chain element.
Figure 2:
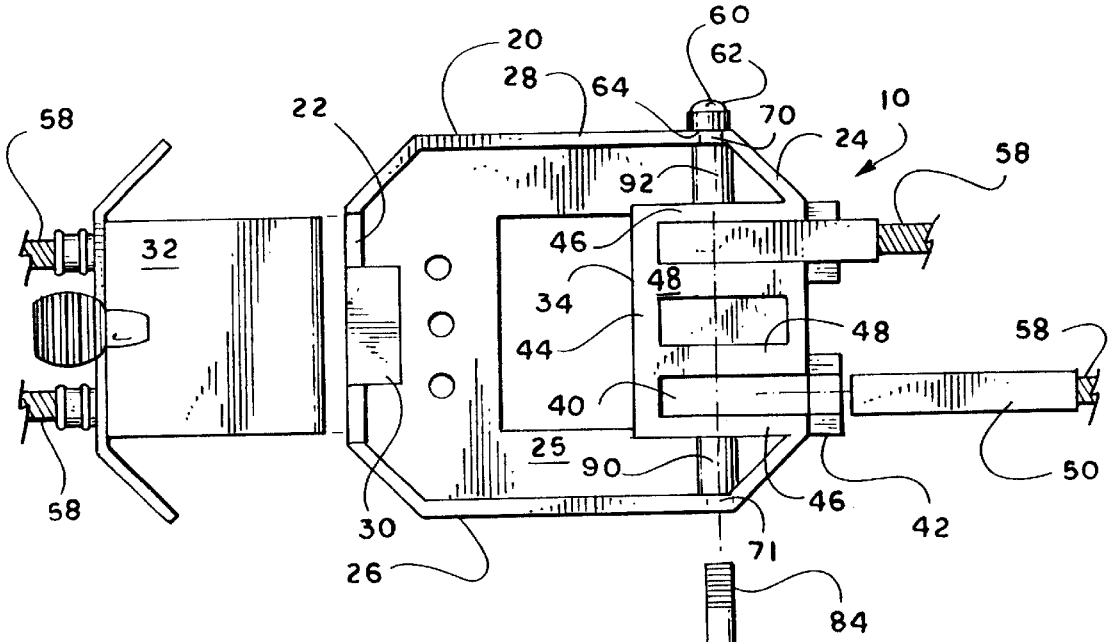
FIG. 2 is a top view of the jewelry clasp of the present invention positioned adjacent a clasp assembly housing according to a preferred embodiment of the present invention, and further showing the disengaged threaded screw and two rectangular pins with chain elements; and, FIG. 3 is a perspective view of a rectangular pin of the present invention attached to a chain element.
Figure 3:
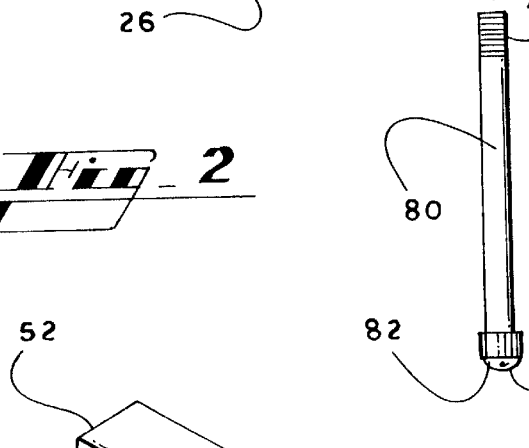
Figure 3:
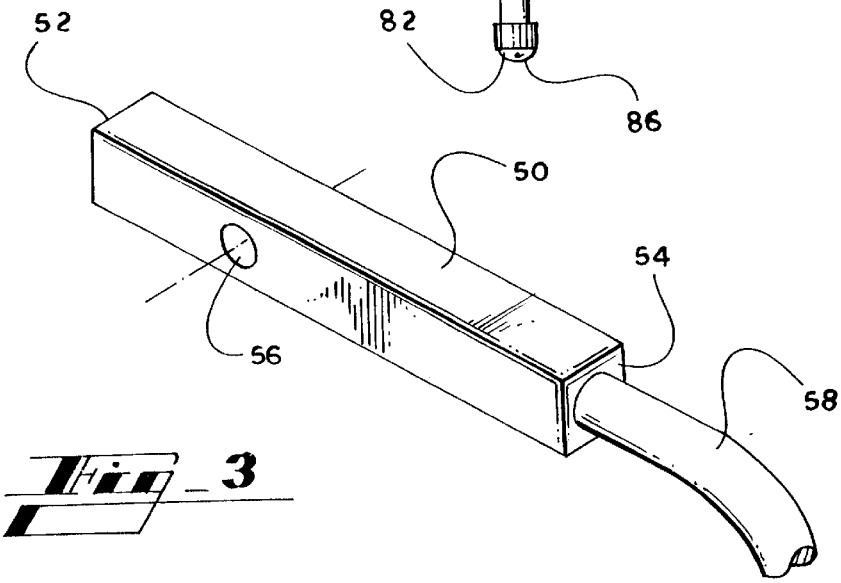

Referring now to FIGS. 1 through 3, the present invention, according to the preferred embodiment, is a jewelry clasp 10 attached to, or formed within, a housing 20 having first end wall 22, second end wall 24, first side wall 26, second side wall 28 and bottom wall 25, wherein first end wall 22 further comprises female clasp receptacle 30, well-known in the art for receiving and securing a male clasp 32, also well-known in the art, of the type best described as a single-hand operable, spring-biased clasp. Best seen with reference to FIG. 1, gems G and pearls P, along with such other decorative features as may be desirable, may be provided to enhance the beauty and value of the jewelry clasp.

A portion of second end wall 24 of housing 20 is preferably removed or cutout to receive clasp 10. Formed in first side wall 26 and second side wall 28, and proximal to second end wall 24 are through-holes 70 and 71, respectively. Clasp 10 preferably is formed or soldered adjacent bottom wall 25, second end wall 24, first side wall 26, and second side wall 28.

Clasp 10 preferably comprises first cylindrical sleeve 90, second cylindrical sleeve 92, body portion 34, receiving channels 40, rectangular-shaped pins 50, retaining pin 80, and threaded receptacle 60. Receiving channels 40 are shaped and dimensioned for slidably receiving preferably rectangular-shaped pins 50. First cylindrical sleeve 90 and second cylindrical sleeve 92 are positioned to align with through-holes 70 and 71, respectively. Threaded receptacle 60 is dimensioned for receiving the threaded portion 84 of retaining pin 80, wherein threaded receptacle 60 may be formed, soldered, or otherwise attached to first side wall 28 adjacent through-hole 71 or, alternatively, threaded receptacle 60 may be formed, soldered, or otherwise attached to second side wall 26 at through-hole 70. It should be noted that, in an alternate embodiment, clasp 10 is formed without threaded receptacle 60, wherein the internal portion of first cylindrical sleeve 90 and/or second cylindrical sleeve 92 are threaded for receiving and securing retaining pin 80. In an additional alternate embodiment, it is contemplated that clasp 10 is formed without first cylindrical sleeve 90 and/ or second cylindrical sleeve 92.

Receiving channels 40 are shaped and dimensioned to receive one each of rectangular-shaped pins 50, wherein each of receiving channels 40 is defined by bottom wall 42, rear wall 44, outer side wall 46, and inner side wall 48. Preferably, bottom wall 42 extends outwardly from second end 24 of clasp housing 20. Outer side wall 46 and inner side wall 48 of each receiving channel 40 further comprise through-holes 49 preferably perpendicular thereto and proximal to rear wall 44. Through-holes 49 align with first cylindrical sleeve 90 and second cylindrical sleeve 92, and, thus, through-hole 70 and through-hole 71, respectively.

Rectangular-shaped pins 50 each comprise first end 52, second end 54, and through-hole 56, wherein through-hole 56 is dimensioned for receiving retaining pin 80 and is proximal to first end 52. Upon engagement with clasp 10, through-hole 56 may be aligned with through-holes 49 of receiving channels 40, and, thus, first cylindrical sleeve 90 and second cylindrical sleeve 92. As such, when retaining pin 80 is inserted into through-hole 70 or through-hole 71, retaining pin 80 extends through first cylindrical sleeve 90, through-holes 49, through-holes 56, and second cylindrical sleeve 92. Second end 54 of retaining pin 80 has chain 58 formed, soldered, or otherwise attached thereto. It should be noted that although rectangular-shaped pins are preferred, other shapes, such as cylindrical, polyhedral, or the like, may be utilized. It also should be recognized that chain 58 may be of any style, form, or fashion known in the art, for example, link-type chains, cable-type chains, or the like.

Threaded receptacle 60 comprises an outer surface 62 and an inner surface 64. Preferably inner surface 64 comprises an inner diameter that is threaded to cooperate with and secure threaded portion 84 of retaining pin 80 therein.

Retaining pin 80 comprises first end 82, further comprising head 86 attached or formed thereto, and threaded portion 84, threaded portion 84 being dimensioned to cooperate with and secure into threaded receptacle 60. Retaining pin 80 is shaped and dimensioned to extend through through-holes 70, 71, 56, and 49.

In use, after the user adds or removes the desired number of slides by sliding over pin 50 and onto chain 58, rectangular shaped pins 50 are inserted into receiving channels 40 such that pin through-holes 56 align with receiving channel through-holes 49. Retaining pin 80 is then inserted into through-hole 70, passed through channel through-holes 49, pin through-holes 56, and through-hole 71, and, finally, secured into threaded receptacle 60. Alternatively, retaining pin 80 may be first inserted into through-hole 71 and secured within threaded receptacle 60 at through-hole 70. By reversing the above steps, the user can disengage the clasp 10 and remove or add additional slides.

In an alternate embodiment, clasp 10 may comprise one or any number of receiving channels 40 for receiving rectangular shaped pins 50; thus, carrying one or any number of chains 58.

It should also be noted that in another alternate embodiment, pins 50 may be of any known shape such as, for exemplary purposes only, cylindrical, polyhedral, or the like.

In yet another alternate embodiment, more than one threaded receptacle 60 may be utilized to reduce the likelihood of accidental disengagement. Additionally, threaded receptacle 60 may be so dimensioned as to reside flush within first side wall 26 or second side wall 28. It is further contemplated that receptacle 60 comprises a snap or pinch fitting, well-known within the art.

In still another embodiment, the receiving channels 40 are disposed in an alternative orientation such that pin through-holes 56 align with receiving channels 40 and receiving channel through-holes 49 in a vertical plane. In this embodiment, rectangular shaped pins 50 may be affixed on each end of the chain 58, and the entire clasp 10 portion may be oriented vertically, such that retaining pin 80 may be inserted into through-hole 70, passed through channel through-holes 49, pin through-holes 56, and through-hole 71, and, finally, secured into threaded receptacle 60, all in a vertical configuration.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A jewelry clasp for use with an elongated chain element, the chain element having first and second ends, the jewelry clasp comprising:

a body portion formed to define a receiving channel, said body portion comprising a first end, a second end, a first side, a second side, a first through-hole formed in said first side, and a second through-hole formed in said second side;

a pin comprising a first end, a second end, and a through-hole formed through said pin, the first end of said chain element being secured to said first end of said pin;

a retaining pin comprising a first end and a second end;

means for removably securing said retaining pin within said body portion; and, a female clasp receptacle, disposed distally from said receiving channel of said body portion, for removably receiving the second end of said chain element when said chain element is secured to a single-hand operable male clasp, wherein said through-hole of said pin may be aligned with said first and second through-holes of said body portion, and wherein said first end of said retaining pin may be extended through each of said through-holes and into said securing means; thereby, removably securing said pin, and, thus, the chain element, to said body portion.

2. The jewelry clasp of claim 1, wherein said first end of said retaining pin further comprises threads, and wherein said securing means comprises a threaded receptacle for cooperatively receiving said threads of said retaining pin.

3. The jewelry clasp of claim 2, wherein said threaded receptacle is generally dome shaped.

4. The jewelry clasp of claim 1, wherein said securing means is a friction fitting.

5. The jewelry clasp of claim 1, wherein said body portion comprises a plurality of receiving channels.

6. The jewelry clasp of claim 5, further comprising a plurality of pins, for securing chain elements.

7. The jewelry clasp of claim 1, wherein said pin for securing chain elements is dimensioned to sidably engage within said receiving channel.

8. The jewelry clasp of claim 1, further comprising a first sleeve aligned with said first through-hole of said body portion and a second sleeve aligned with said second through-hole of said body portion to provide additional guiding support to said retaining pin.

9. A jewelry clasp for securing a plurality of elongated jewelry members, each of said jewelry members comprising a first end and a second end, wherein said jewelry clasp is carried by a housing having a first end, a second end, a first side, a second side, a first through-hole formed through said first side, and a second through-hole formed through said second side, said jewelry clasp comprising:

a body portion carried by said housing at the second end of said housing, said body portion formed to define a plurality of receiving channels, said body portion comprising a first end, a second end, a first side, and a second side, said body portion further comprising a bore formed and extending through said body portion and aligned with said first through-hole and said second through-hole of said housing;

a plurality of pins each comprising a first end, a second end, and a through-hole passing through said pin, each of said pins being paired with a corresponding jewelry member and secured thereto such that the first end of said jewelry member is affixed to the first end of said pin, each of said pins being dimensioned slidably to engage with a receiving channel;

a retaining pin having a first end and a second end; and, means for removably securing said retaining pin within said body portion, wherein each of said through-holes of said pins may be aligned with said bore of said body portion and the first and second through-holes of the housing, and wherein said first end of said retaining pin may be extended through each of said through-holes of the housing, said through-holes of said pins, said bore of said body portion, and into said securing means; thereby, removably securing said pins, and, thus, the elongated jewelry members to said body portion.

10. The jewelry clasp of claim 9, wherein said first end of said retaining pin further comprises threads, and wherein said securing means comprises a threaded receptacle for cooperatively receiving said threads of said retaining pin.

11. The jewelry clasp of claim 10, wherein said threaded receptacle is generally dome shaped.

12. The jewelry clasp of claim 9, further comprising a first sleeve aligned adjacent said bore on said first side of said body portion and said first through-hole of said housing, and a second sleeve aligned adjacent said bore on said second side of said body portion and said second through-hole of said housing, to provide additional guiding support to said retaining pin.

13. The jewelry clasp of claim 9, further comprising a female clasp receptacle, disposed distally from said receiving channels of said body portion, for removably receiving the second ends of said jewelry members when said jewelry members are secured to a single-hand operable male clasp.

14. A jewelry clasp for securing a plurality of elongated jewelry members, each of said jewelry members having a first end and a second end, said jewelry clasp comprising:

a housing having a first end, a second end, a first side, a second side, a first through-hole formed through the first side and a second through-hole formed through the second side;

a clasp carried at said first end of said housing;

a body portion carried at said second end of said housing, said body portion formed to define a plurality of receiving channels, said body portion comprising a first end; a second end, a first side, and a second side, said body portion further comprising a bore formed and extending through said body portion and aligned with said first through-hole and said second through-hole of said housing;

a plurality of pins each comprising a first end, a second end, and a through-hole passing through said pin, each of said pins being paired with a corresponding jewelry member and secured thereto such that the first end of said jewelry member is affixed to the first end of said pin, each of said pins being dimensioned slidably to engage with a receiving channel;

a retaining pin having a first end and a second end; and, means for removably securing said retaining pin within said body portion, wherein each of said through-holes of said pins may be aligned with said bore of said body portion and the first and second through-holes of the housing, and wherein said first end of said retaining pin may be extended through each of said through-holes of the housing, said through-holes of said pins, said bore of said body portion, and into said securing means; thereby, removably securing said pins, and, thus, the elongated jewelry members to said housing.

15. The jewelry clasp of claim 14, wherein said first end of said retaining pin further comprises threads, and wherein said securing means comprises a threaded receptacle for cooperatively receiving said threads of said retaining pin.

16. The jewelry clasp of claim 15, wherein said threaded receptacle is generally dome shaped.

17. The jewelry clasp of claim 14, further comprising a first sleeve aligned adjacent said bore on said first side of said body portion and said first through-hole of said housing, and a second sleeve aligned adjacent said bore on said second side of said body portion and said second through-hole of said housing, to provide additional guiding support to said retaining pin.

18. The jewelry clasp of claim 14, wherein said clasp carried at said first end of said housing further comprises a female clasp receptacle for removably receiving the second ends of said jewelry members when said jewelry members are secured to a single-hand operable male clasp.

19. A method of adding slides to a jewelry member, comprising the steps of:

a. obtaining a jewelry clasp comprising a body portion formed to define a receiving channel, said body portion comprising a first end, a second end, a first side, a second side, a first through-hole formed in said first side, and a second through-hole formed in said second side; a pin comprising a first end, a second end, and a through-hole formed through said pin, the first end of said chain element being secured to said first end of said pin; a retaining pin comprising a first end and a second end; means for removably securing said retaining pin within said body portion; and, a female clasp receptacle, disposed distally from said receiving channel of said body portion, for removably receiving the second end of said chain element when said chain element is secured to a single-hand operable male clasp;

b. sliding at least one slide over said pin and onto said chain;

c. inserting said second end of said pin into said receiving channel;

d. inserting said retaining pin through said clasp through-holes and said through-hole of said pin; and, e. removably securing said retaining pin therein.

* * * * *